US005139017A

United States Patent [19]

McCloud

[11] Patent Number: 5,139,017

[45] Date of Patent: Aug. 18, 1992

[54] BICYCLE HELMET HAVING AIR FILTERING AND BREATHING MEANS

[76] Inventor: Russell D. McCloud, 15 Pine La., St. Rose, La. 70087

[21] Appl. No.: 709,697

[22] Filed: Jun. 3, 1991

[51] Int. Cl.[5] ..... A62B 18/10

[52] U.S. Cl. ..... 128/201.28; 128/201.25; 128/201.26

[58] Field of Search ..... 128/201.22, 201.25, 128/201.26, 201.28; 2/171.3, 410, 411, 413, 425

[56] References Cited

U.S. PATENT DOCUMENTS

| | | | |
|---|---|---|---|
| 1,150,460 | 9/1915 | Schreiber | 128/201.26 |
| 3,068,865 | 12/1962 | Laszlo | 128/200.28 |
| 3,491,752 | 1/1970 | Cowley | 128/201.22 |
| 3,683,907 | 8/1972 | Cotabish | 128/201.22 |
| 4,434,514 | 3/1984 | Sundahl et al. | 2/425 |
| 4,443,891 | 4/1984 | Blomgren et al. | 2/425 |
| 4,555,816 | 12/1985 | Broersma | 2/425 |
| 4,586,200 | 5/1986 | Poon | 2/413 |
| 4,653,123 | 3/1987 | Broersma | 2/425 |
| 4,995,117 | 2/1991 | Mirage | 2/425 |
| 5,023,958 | 6/1991 | Rotzin | 2/425 |

*Primary Examiner*—Edgar S. Burr
*Assistant Examiner*—Aaron J. Lewis
*Attorney, Agent, or Firm*—George A. Bode; Michael L. Hoelter

[57] ABSTRACT

This invention pertains to a protective helmet having a plurality of vents therein and air supply tubing and filtration element for supplying filtered air to a user. The air supply tubing is connected to the filtration element mounted in the helmet and delivers this filtered air through an inlet one-way valve and a mouthpiece to the user upon demand. The inlet and an exit one-way flow valve maintain the proper flow direction during the inhale and exhale phases and prevent any back-flow from occurring.

9 Claims, 5 Drawing Sheets

BICYCLE HELMET HAVING AIR FILTERING AND BREATHING MEANS

BACKGROUND OF THE INVENTION

1. Field of the Invention

The present invention pertains to a new design for a bicycle helmet and more specifically to a helmet having an apparatus for providing filtered and purified air to the user.

2. General Background

Numerous bicycle helmets exist which use air flow to cool the rider. Advances have been made to improve upon such cooling by positioning the openings at specific locations and by carefully adjusting their number and size. While much thought has been given to this use of the air flowing through or across the helmet, little thought has been given to purifying this air and supplying it to the user to breath.

In an urban environment, exhaust fumes, pollution, smog, and other substances are ingested by the typical bicyclist. In rural environments, duct, pollen, herbicides, and pesticides may be breathed. Thus, while the typical bicyclist may believe that an outing may be doing some aerobic good, it may also cause that person to become sick due to the exposure to these pollutants.

Furthermore, people with allergies may refrain from bicycle riding because of the discomfort experienced either during or after such riding. Alternatively, off-road bicyclists require protection from the dirt, gravel, and debris that becomes airborne, with such particles creating a hazard should they enter or become lodged in the rider's mouth or windpipe.

It is thus an objective of this invention to utilize the air flowing through and/or across a helmet to both cool the rider and as a source of clean air for breathing.

Another object of this invention is to supply filtered air to the user to protect against the inhalation of foreign matter.

A further object of this invention is to provide a bicycle helmet with a flexible mouthpiece for breathing that is available on an as needed basis. These and other objects will become obvious upon further investigation.

SUMMARY OF THE PRESENT INVENTION

The preferred embodiment of the apparatus of the present invention solves the aforementioned problems in a straight forward and simple manner. What is provided is a helmet having an outer shell with a plurality of openings therein for forced ventilation purposes. Attached to the front of the helmet are filtration means for filtering incoming air which connect to supply means that direct this filtered air to a mouthpiece for use by the user upon demand. An inlet one-way flow valve and an exit one-way flow valve insure proper air flow direction and prevent any backflow through the system.

BRIEF DESCRIPTION OF THE DRAWINGS

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 3:
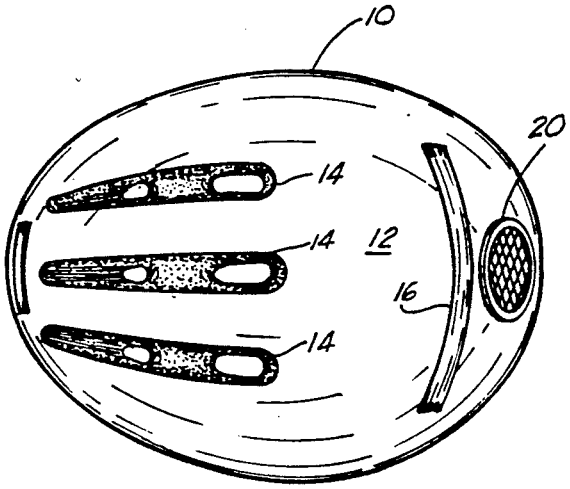
FIG. 3 is a top pictorial view of the embodiment of FIG. 1.
Figure 1:
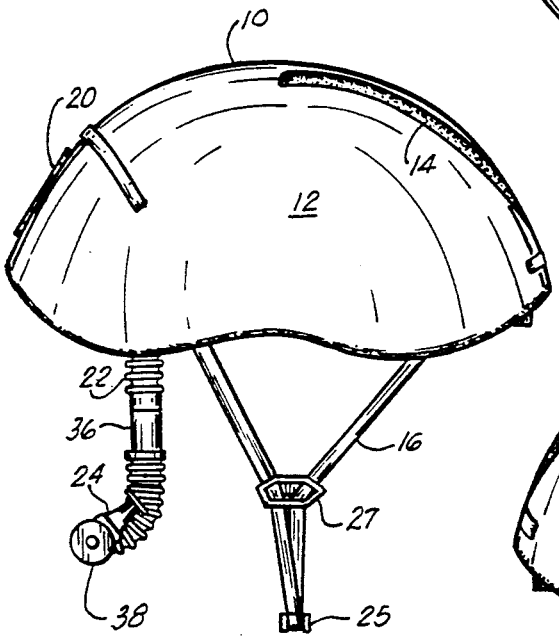
FIG. 1 is a left side pictorial view of the preferred embodiment of the apparatus of the present invention.
Figure 2:
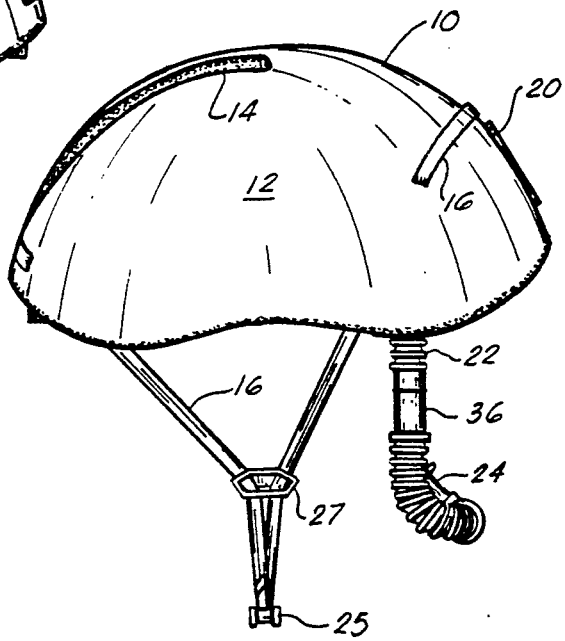
FIG. 2 is a right side pictorial view of the embodiment of FIG. 1.
Figure 6:
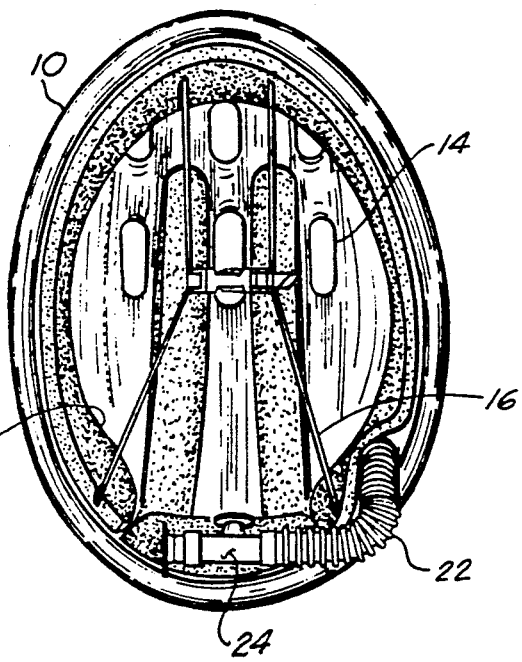
FIG. 6 is a bottom pictorial view of the embodiment of FIG. 1.
Figure 5:
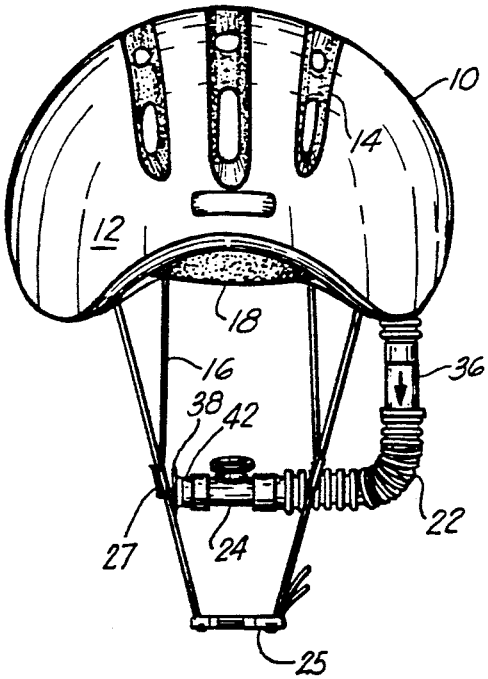
FIG. 5 is a back pictorial view of the embodiment of FIG. 1.
Figure 4:
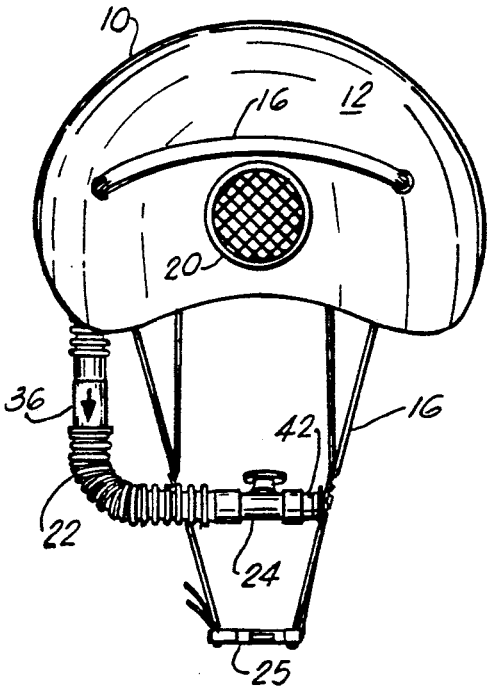
FIG. 4 is a front pictorial view of the embodiment of FIG. 1.
Figure 7:
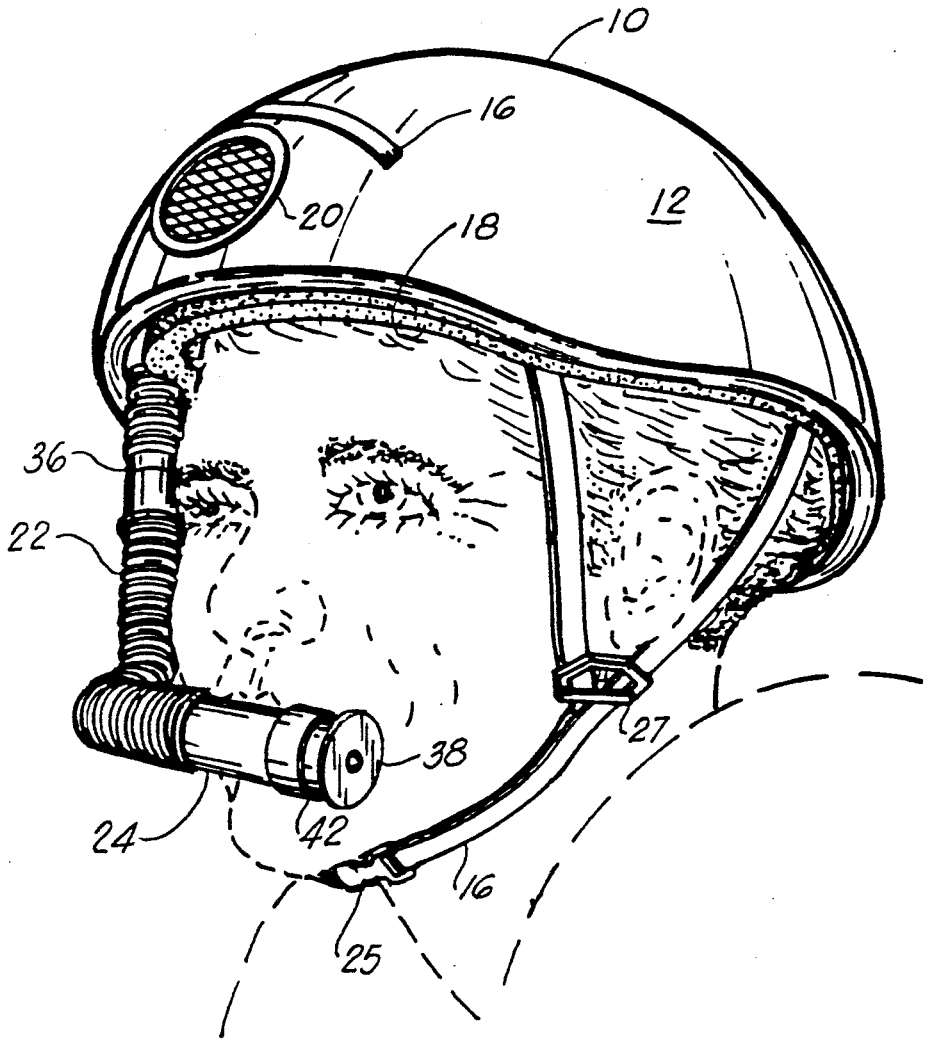
FIG. 7 is a top perspective pictorial view of the invention while in use.

Referring now to the drawing, and in particular FIGS. 1–7, the apparatus of the present invention is designated generally by the numeral 10. Apparatus 10 includes a hard helmet shell 12, aerodynamic air vents 14 therein, strapping 16, and interior foam lining 18. Each of these components 12, 14, 16, and 18 are of typical design and construction with their configuration and/or location varying as needed. In the preferred embodiment, as best seen in FIGS. 1–5, three elongated vents 14 from the crown of shell 12 towards its rear periphery are provided. Strapping 16 passes through the shell 12 in the front portion thereof and joins below it in fastening means 25. Adjustment means 27 on each side of strapping 16 allows the user to adjust the fit to his head size and needs. Shell 12 can be of hard plastic of light weight foam, more or fewer vents 14 can be utilized, straps 16 includes the necessary hardware 25, 27 for proper fit and adjustment, while foam lining 18 could be removable or adjustable as needed. Helmet 10 also comprises filter assembly 20 mounted in the forward portion of shell 12 and connected to one end of flexible supply tube 22, and, mouthpiece 24 connected to supply tube 22 at the other end. FIG. 7 illustrates the operation of helmet 10 by a user.

Figure 8:
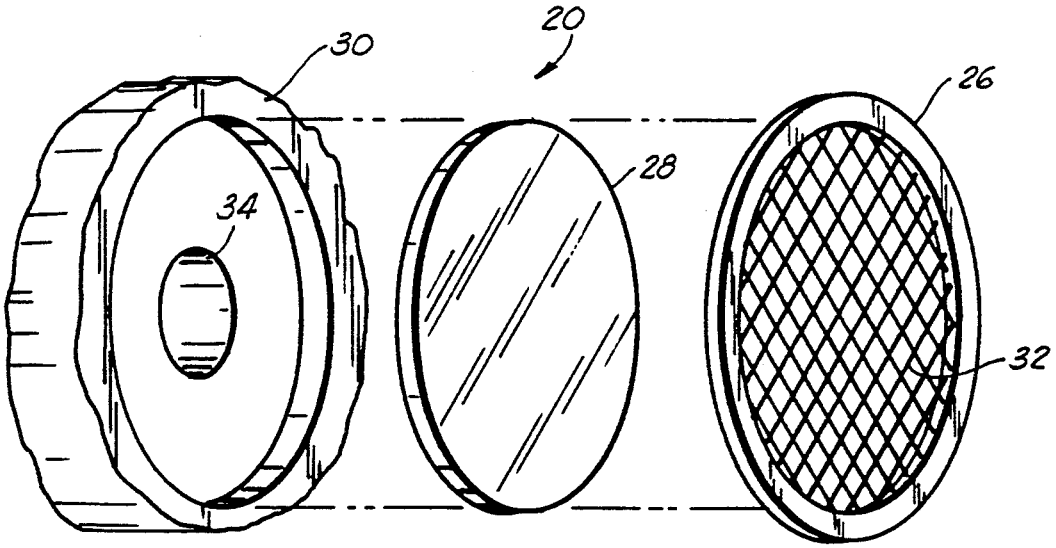
FIG. 8 is an exploded broken-away view of the filter assembly.

A broken-away exploded view of filter assembly 20 is shown in FIG. 8. As disclosed, filter assembly 20, which is located in the front of helmet 10, includes outer mesh screen 26, removable filter 28, and base 30. Obviously, outer mesh screen 26 is designed to both protect filter assembly 20 and to prevent large objects from entering and thereby clogging filter assembly 20. Outer mesh screen 26 is removable for cleaning or repair purposes if such is required. Mesh 32 can be flexible or rigid and it can be made of metal, wire, nylon, plastic or some such other substance.

Filter 28 removes the smaller particles that pass through mesh 32. It can be a device that merely mechanically filters such particles (such as by using a paper or other fibrous filter) or the particles can be removed via chemical reaction (such as by using activated charcoal or the like). Filter 28 is removable and/or replaceable should it become plugged, clogged, or consumed. As shown, filter 28 is pressed between mesh screen 26 and base 30, but filter 28 could also be screwed, snapped or otherwise held in place as needed.

Base 30 holds mesh screen 26 and filter 28 in place as shown. It is firmly attached to helmet 10 and is generally not removable unless repairs unless repairs are needed. Portal opening 34 in base 30 provides air access to supply tube 22 and thence to the user.

Supply tube 22 is generally constructed of flexible corrugated rubber tubing so that mouthpiece 24 will be comfortable during use. While a more rigid material will not conform to the user's needs as quickly and as effortlessly as the more flexible material will. Additionally, flexible supply tube 22 will also enable the user to rotate his or her head as needed without any hindrance. About the only necessary requirement for supply tube 22 is that it maintain the filtered and purified status of the air flowing through it.

Figure 9:
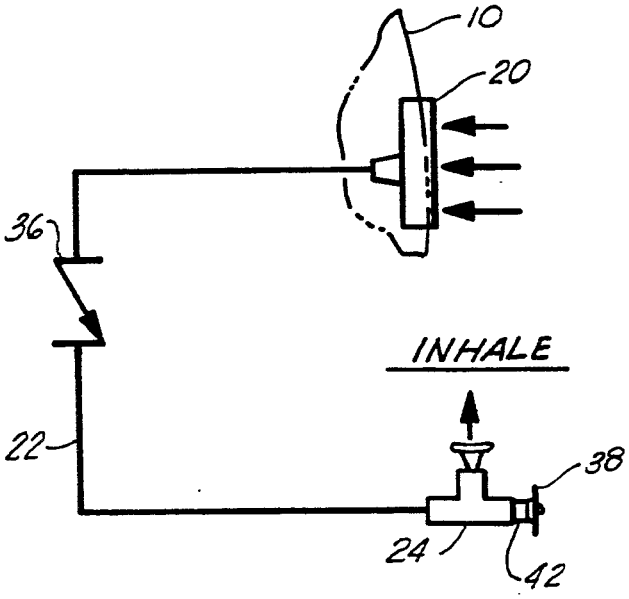
FIG. 9 is a schematic view diagramming the inhalation phase.
Figure 10:
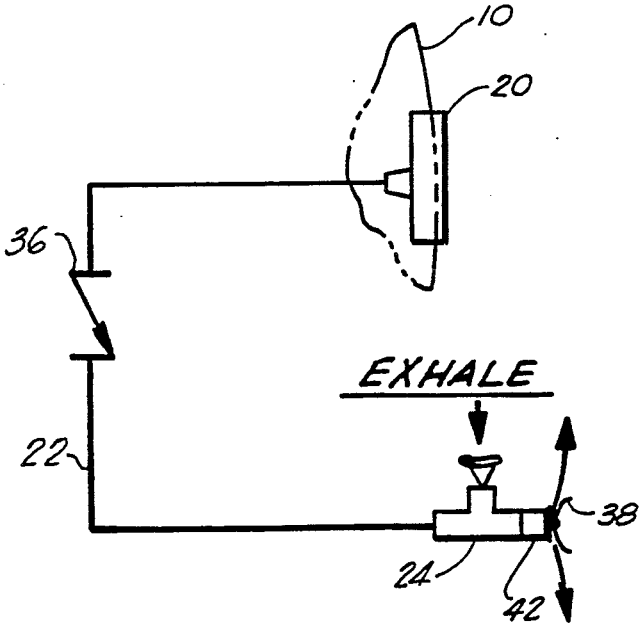
FIG. 10 is a schematic view diagramming the exhalation phase.

FIGS. 9 and 10 schematically illustrate the operation of helmet 10. During inhalation, the user draws a portion of the forced cooling air passing through or around helmet 10 via filter assembly 20 and supply tube 22. This drawn air passes through filter 28 for purification and then travels through intake check valve 36 before entering the user via mouthpiece 24. Intake check valve 36 insures that air passage though supply tube 22 is in one direction only. Valve 36 is preferably a simple membrane or fabric-type check valve (FIG. 12) which incorporates a flexible membrane 38 over an opening 40 that flexes in response to a pressure differential across the valve. Thus, when the flow is in the proper direction, membrane 38 flexes in response to a pressure differential across the valve. Thus, when the flow is in the proper direction, membrane 38 flexes open, but membrane 38 remains closed when the flow is in the opposite direction. Any other type of one-way flow valve is also acceptable.

Adjacent mouthpiece 24 is exit check valve 42 which remains closed during the inhalation process. Exit check valve 42 is preferably also a membrane type one-way valve, but other types are equally suitable. Exit check valve 42, as can be imagined, is closed during inhalation so as to prevent unfiltered air from entering mouthpiece 24. However, during exhalation, exit check valve 42 opens while intake check valve closes. This enables the exhaled air to be discharged from mouthpiece 24 without re-passing through filter assembly 20.

Thus, as can be see, during inhalation, intake check valve 36 is open with exit check valve 42 being closed. Likewise, during exhalation, intake check valve 36 is closed with exit check valve 42 being open. Consequently, while one valve is opening, the other is closing and vice-versa. Thus a steady flow of air is supplied to the user upon demand.

Figures 11, 12:
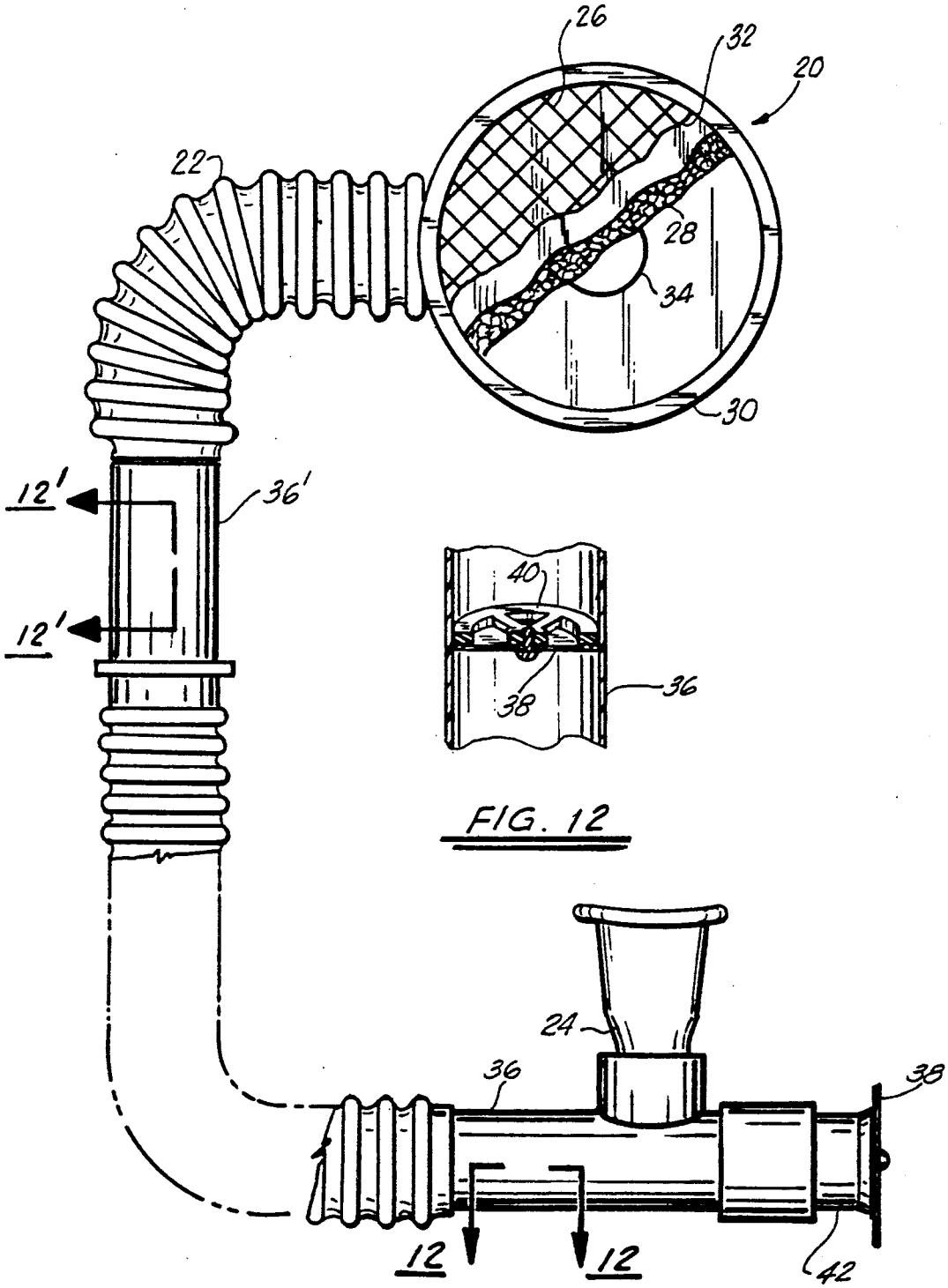
FIG. 11 is an enlarged pictorial view, partially broken away, of the filter assembly and supply tube; and, FIG. 12 is a sectional view, partially broken away, of a typical one-way flow valve taken along either lines 12—12 of FIG. 11 or lines 12'—12' of FIG. 11.

While FIGS. 9, 10 and 11 illustrate intake check valve 36 mid-way along supply tube 22 (see section Lines 12'—12'), it could be placed anywhere upstream mouthpiece 24. Preferably, however, its location would be adjacent mouthpiece 24 (see section Lines 12—12) but opposite exit check valve 42. This is because the closer these valves are to mouthpiece 24 the more efficient their operation since they require the existence of a pressure differential for optimum performance. Also, access to these check valves is provided for cleaning and/or repair purposes.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A protective helmet comprising:

(a) an outer shell configured to fit and be secured around the upper portion of a user's head, said shell having frontal and rear openings therein for forced outside air ventilation through said helmet;

(b) filtration means secured to the front of said shell in said frontal opening for filtering said outside air forced through said frontal opening;

(c) supply means coupled to said filtration means for supplying said filtered air to the mouth of said user, said supply means including an elongated tube having a mouthpiece positioned near the distal end thereof;

(d) an inlet one-way flow valve provided within said elongated tube and positioned upstream of said mouthpiece intermediate said filtration means and mouthpiece; and, (e) an exit one-way flow valve coupled to said elongated tube and positioned downstream of said mouthpiece;

(f) whereby when said user inhales outside air which passes through said frontal opening, said filtration means, said supply means, said inlet one-way flow valve, and said mouthpiece, said exit one-way flow valve is closed; and, whereby when said user exhales air which passes through said mouthpiece and out of said exit one-way flow valve, said inlet one-way flow valve is closed.

2. The apparatus of claim 1, wherein said helmet further comprises straps for securing said helmet to said user and wherein said helmet comprises cushion means for cushioning said helmet upon said head.

3. The apparatus of claim 2, wherein said supply means comprises a single flexible tube extending between said filtration means and said mouthpiece.

4. The apparatus of claim 3, wherein said inlet one-way flow valve and said exit one-way flow valve are of the flexible membrane type.

5. The apparatus of claim 4, wherein said inlet one-way flow valve and said exit one-way flow valve are positioned immediately adjacent, but on opposite sides of, said mouthpiece.

6. The apparatus of claim 4, wherein said filtration means are removable for replacement and/or repair.

7. The apparatus of claim 6, wherein said filtration means include an outer mesh screen.

8. The apparatus of claim 7, wherein said filtration means include activated charcoal filter.

9. The apparatus of claim 7, wherein said filtration means include a paper or other fibrous filter.

* * * * *